US010077586B2

(12) United States Patent
Buckner

(10) Patent No.: US 10,077,586 B2
(45) Date of Patent: Sep. 18, 2018

(54) DOOR LOCKING DEVICE FOR DEBRIS TANK

(71) Applicant: VAC-TRON EQUIPMENT, LLC, Okahumpka, FL (US)

(72) Inventor: Don M. Buckner, Okahumpka, FL (US)

(73) Assignee: VAC-TRON EQUIPMENT, LLC, Okahumpka, FL (US)

( * ) Notice: Subject to any disclaimer, the term of this patent is extended or adjusted under 35 U.S.C. 154(b) by 414 days.

(21) Appl. No.: 15/042,536

(22) Filed: Feb. 12, 2016

(65) Prior Publication Data

US 2017/0234045 A1 Aug. 17, 2017

(51) Int. Cl.

| | |
|---|---|
| ***E05C 19/10*** | (2006.01) |
| ***E05C 3/02*** | (2006.01) |
| ***E05C 3/12*** | (2006.01) |
| ***E05C 3/06*** | (2006.01) |
| ***E05C 3/14*** | (2006.01) |
| ***E05B 65/00*** | (2006.01) |
| ***B65D 45/34*** | (2006.01) |
| ***E05C 19/12*** | (2006.01) |
| ***E05B 63/12*** | (2006.01) |
| ***E05B 85/24*** | (2014.01) |
| ***E05B 57/00*** | (2006.01) |
| ***B65D 43/22*** | (2006.01) |
| ***E02F 9/00*** | (2006.01) |
| ***E05C 9/02*** | (2006.01) |

(52) U.S. Cl.

CPC ..... *E05C 19/12* (2013.01); *B65D 43/22* (2013.01); *E02F 9/00* (2013.01); *E05C 9/028* (2013.01)

(58) Field of Classification Search

CPC ..... B65D 43/22; E05C 19/12; E05C 19/14; E05B 63/122; E05B 85/24; E05B 57/00; F16J 13/18

See application file for complete search history.

(56) References Cited

U.S. PATENT DOCUMENTS

| | | | | |
|---|---|---|---|---|
| 4,105,240 | A | 8/1978 | Steenson et al. | |
| 4,519,739 | A | 5/1985 | Risch | |
| 4,808,062 | A | 2/1989 | Bare | |
| 5,209,530 | A * | 5/1993 | Kolloch | E05C 3/165 292/244 |
| 6,126,216 | A | 10/2000 | Tollefson | |
| 8,814,094 | B2 * | 8/2014 | Tran | B64C 25/26 244/100 R |
| 2003/0155776 | A1 * | 8/2003 | Perez-Sanchez | B64C 1/1476 292/24 |

* cited by examiner

*Primary Examiner* — Andrew T Kirsch

(74) *Attorney, Agent, or Firm* — Matthew G. McKinney, Esq.

(57) ABSTRACT

A door locking device for hydro excavation equipment. The door locking device includes a grapple support housing secured to a door of a debris tank, a lower gripping jaw having a lower pin defining a lower axis about which the lower gripping jaw is configured to rotate, and an upper gripping jaw having an upper pin defining an upper axis about which the upper gripping jaw is configured to rotate. The locking device also includes a yoke having a first end coupled to proximate ends of the lower and upper gripping jaw, and an actuator coupled to a second end of the yoke and configured to extend and retract the yoke to cause the lower and upper gripping jaws to rotate in response thereto about the lower axis and the upper axis, respectively.

20 Claims, 4 Drawing Sheets

FIG. 5
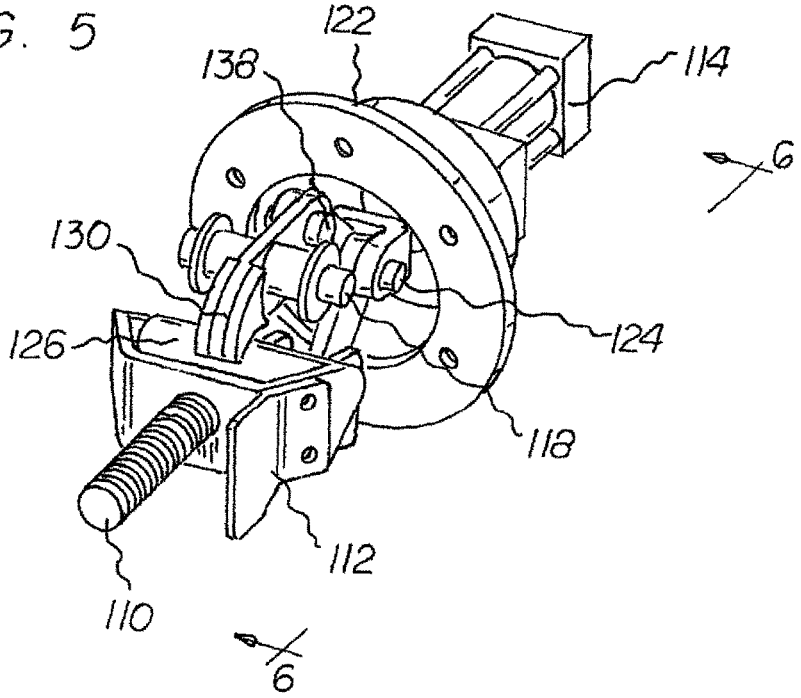
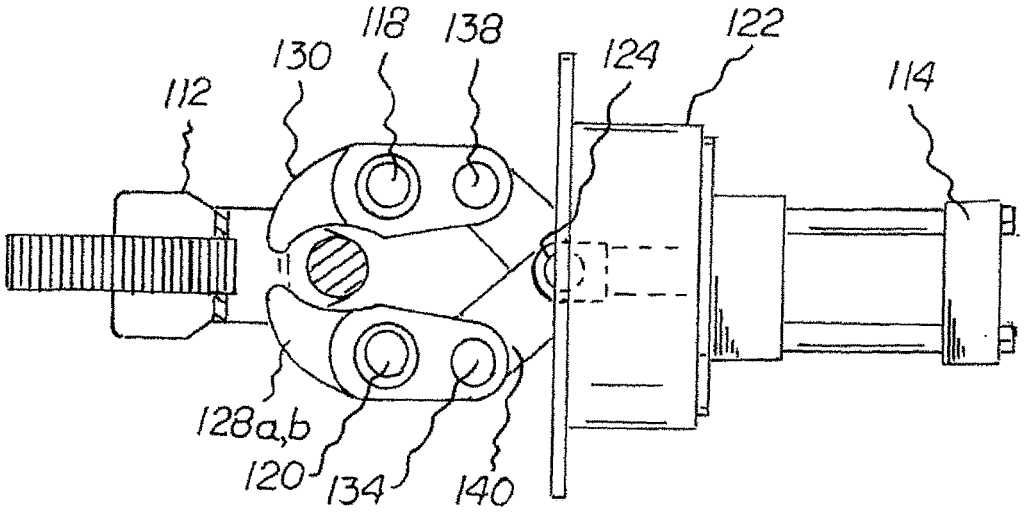
FIG. 6

DOOR LOCKING DEVICE FOR DEBRIS TANK

TECHNICAL FIELD

The present invention relates to the field of hydro excavation, and, more particularly, to a door locking device for a debris tank.

BACKGROUND

Industrial vacuum equipment has dozens of wet and dry uses such as hydro excavation, air excavation and vacuum excavation. In addition, the equipment can be used for directional drilling slurry removal, industrial clean-up, waste clean-up, lateral and storm drain clean-out, oil spill clean-up and other natural disaster clean-up applications. The vacuum systems may be mounted to a truck or trailer and are typically powered by gas or diesel engines.

The vacuum systems include a debris tank that is used to collect the material being suctioned by the system. A swinging type door is used over an open end of the debris tank to access the interior of the debris tank and also for emptying the contents of the debris tank. The door is typically locked in place using manually operated latches. Often times a pair of latches are located at opposing sides along the exterior periphery of the door. However, the latches are susceptible to leaking around the door where an airtight seal is not maintained between the door and the seal of the debris tank because of unequal pressure applied to the door by each latch. Another type of latch system that has been used in the past is located inside the debris tank. However, this type of latch system may be susceptible to breaking loose causing the contents of the debris tank to be inadvertently dumped as the door swings open, possibly when the excavation equipment is being driven on the roadway. Accordingly, what is needed is a door lock system for a debris tank that cannot become inadvertently released and also can apply equal pressure to the door for an airtight seal to the debris tank.

SUMMARY

In view of the foregoing background, it is therefore an object of the present invention to provide a quick, safe and effective apparatus and method of bathing a child.

This and other objects, features, and advantages in accordance with the present invention are provided by a door locking device for hydro excavation equipment that includes a debris tank having an open end and a door pivotally connected thereto. The door locking device includes a grapple support housing secured to the door and having a first side and an opposing second side, a lower gripping jaw having a lower pin coupled between the first side and the second side of the grapple support housing defining a lower axis about which the lower gripping jaw is configured to rotate, and an upper gripping jaw having an upper pin coupled between the first side and the second side of the grapple support housing defining an upper axis about which the upper gripping jaw is configured to rotate. The door locking device also includes a yoke having a first end coupled to proximate ends of the lower and upper gripping jaw, and an actuator coupled to a second end of the yoke and configured to extend and retract the yoke to cause the lower and upper gripping jaws to rotate in response thereto about the lower axis and the upper axis, respectively.

In another embodiment, a door locking device for a debris tank includes a grapple support housing having a first side and an opposing second side. The door locking device also includes a lower gripping jaw having a lower pin coupling the lower gripping jaw to the grapple support housing defining a lower axis about which the lower gripping jaw is configured to rotate, an upper gripping jaw having an upper pin coupling the upper gripping jaw to the grapple support housing defining an upper axis about which the upper gripping jaw is configured to rotate, and a yoke having a first end coupled to proximate ends of the lower and upper gripping jaw. In addition, the door locking device includes an actuator coupled to a second end of the yoke and configured to extend and retract the yoke to cause the lower and upper gripping jaws to rotate in response thereto about the lower axis and the upper axis, respectively, to lock a door over an open end of a debris tank.

BRIEF DESCRIPTION OF THE DRAWINGS

FIG. 5 is a partial perspective view of the grapple of FIG. 4; and

FIG. 6 is a partial elevational view of the grapple of FIG. 3.

DETAILED DESCRIPTION

Figure 1:
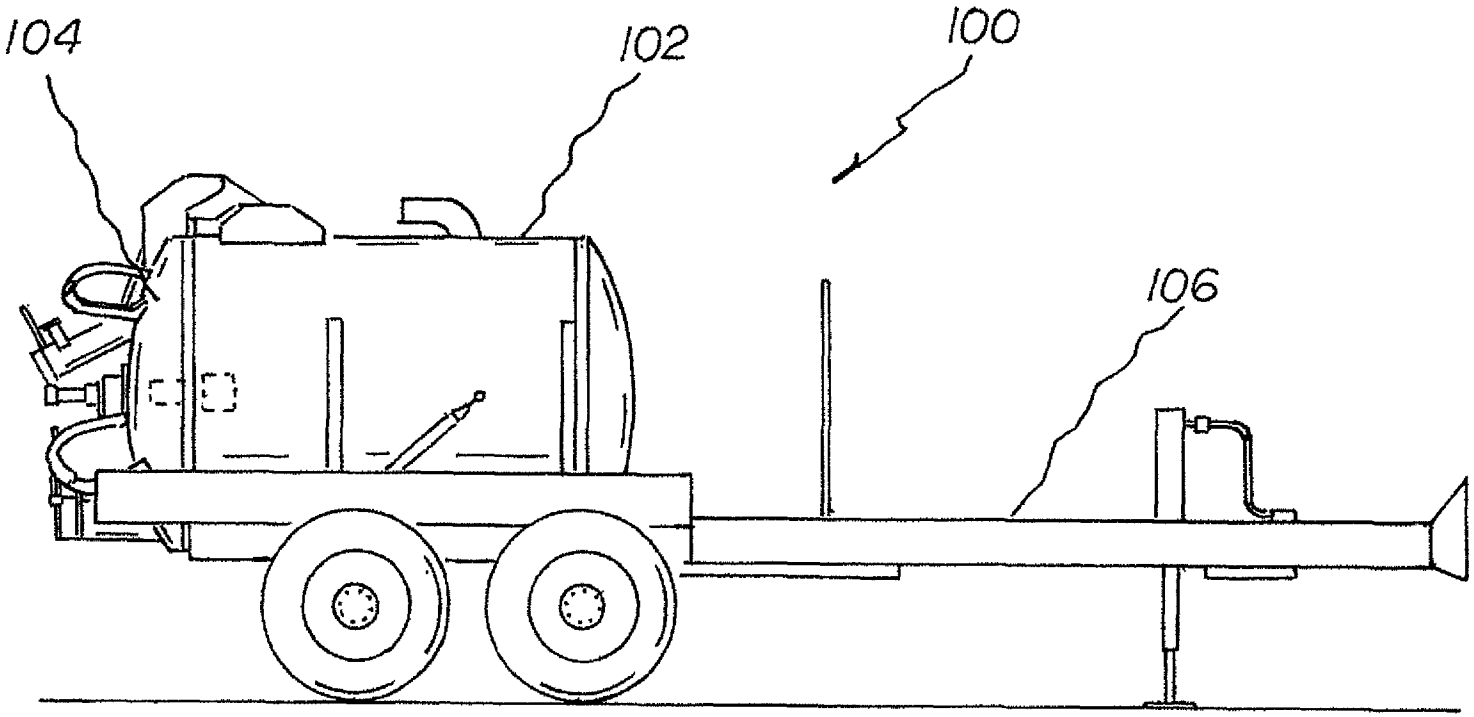
FIG. 1 is an elevational view of hydro excavation equipment in accordance with an embodiment of the present invention.

The present invention will now be described more fully hereinafter with reference to the accompanying drawings, in which preferred embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art Referring initially to FIG. 1, a door locking device is now described. Hydro excavation equipment 100 generally includes a debris tank 102 having a door 104 at the rear, and related pumps, motors and other related equipment (not shown). The door 104 is typically hinged at a top portion of an open end of the debris tank and orientated to swing upwards to open and downwards to close. In addition, the debris tank 102 may be mounted to a trailer 106 for transport. Often times the hydro excavation equipment is mounted to a truck.

Figure 2:
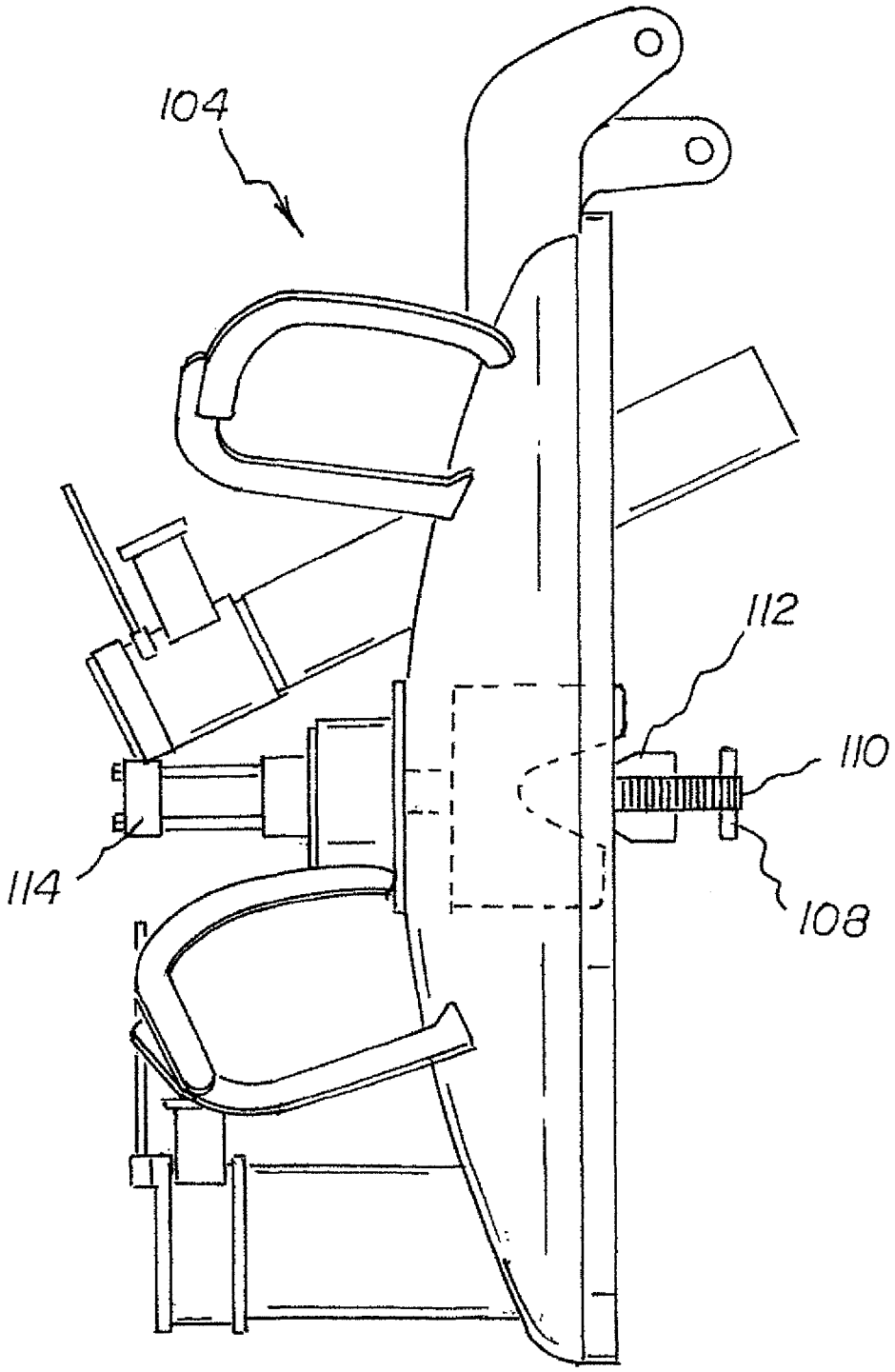
FIG. 2 is an elevational view of a debris tank door of the hydro excavation equipment of FIG. 1.

Referring now to FIG. 2, the door 104 is shown without the debris tank 102. An actuator 114 is mounted concentrically to an exterior of the door 104 and a locking bar support 112 is shown at an interior side of the door 104. A bolt 110 is also shown mounted to the locking bar support and is configured so that the locking bar support 112 can be adjusted horizontally within the debris tank 102 on the interior side of the door 104. A bolt mount 108 is used to mount the bolt within the debris tank 102.

Figure 3:
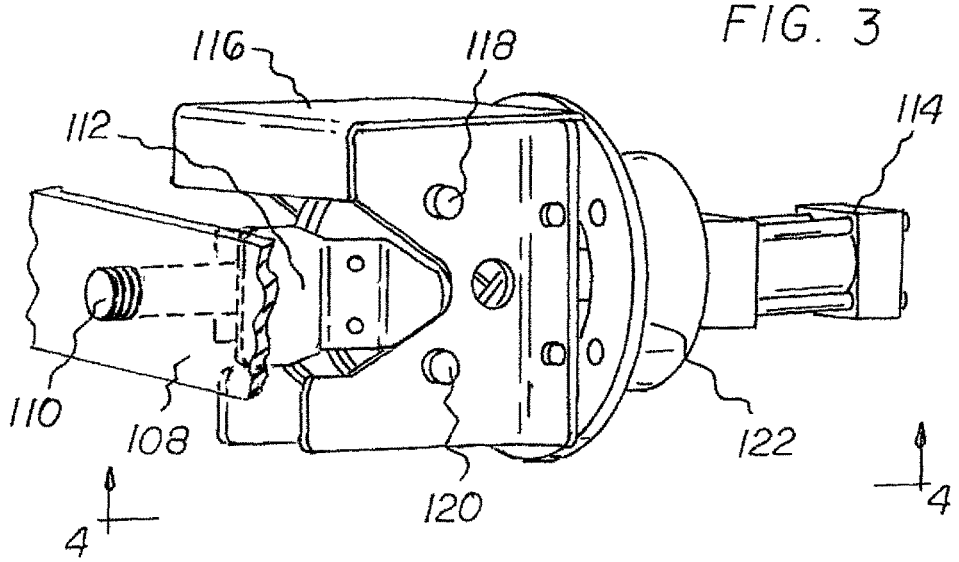
FIG. 3 is a perspective view of a grapple in accordance with an embodiment of the present invention.
Figure 4:
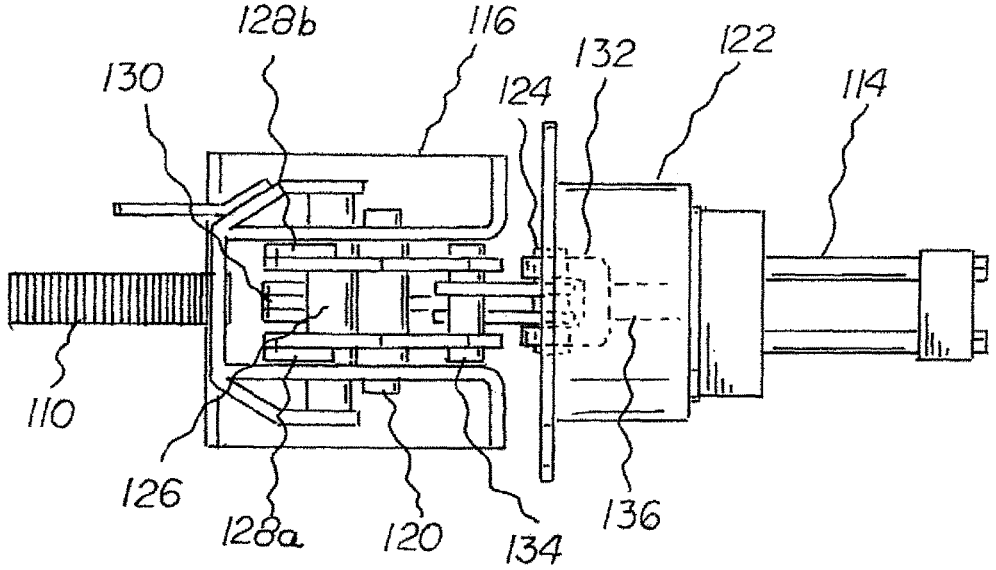
FIG. 4 is a bottom view of the grapple of FIG. 3.

Referring now to FIGS. 3 and 4, a grapple support housing 116 includes a first side and an opposing second side. A lower gripping jaw 128 is coupled between the first side and the second side of the grapple support housing 116 using a lower pin 120, which defines a lower axis about which the lower gripping jaw 128 is configured to rotate. An upper gripping jaw 130 is coupled between the first side and the second side of the grapple support housing 116 using an upper pin 118, which defines an upper axis about which the upper gripping jaw 130 is configured to rotate. The lower axis and the upper axis may be aligned with a midpoint of the lower and upper gripping jaws 128 and 130, respectively.

A yoke 132 includes a first end coupled to proximate ends of the lower and upper gripping jaws 128 and 130. The actuator 114 is coupled to a second end of the yoke 132 and is configured to extend and retract the yoke 132 to cause the lower and upper gripping jaws 128 and 130 to rotate in response thereto about the lower axis and the upper axis, respectively. A bell housing 122 may be secured to the actuator 114.

A locking bar 126 is mounted inside the debris tank 102 and is orientated to receive distal ends of the lower and upper gripping jaws 128 and 130 that can grip the locking bar in order to lock the door 104 over the open end of the debris tank 102 when closed. The lower gripping jaw 128 may include a pair of arms configured to have the upper gripping jaw 130 therebetween (or vice versa) when the door 104 is closed.

The lower gripping jaw 128 is oriented to grip a lower surface of the locking bar 126 and the upper gripping jaw 130 is orientated to grip an upper surface of the locking bar 126 when the door 104 is closed. The distal ends of the lower and upper gripping jaws 128 and 120 are configured to move closer together to grip the locking bar 126 when the actuator 114 is extended, and to move further apart to release the grip on the locking bar 126 when the actuator 114 is retracted.

The yoke 132 may include a lower yoke arm 140 having a distal end coupled to the proximate end of the lower gripping jaw 128, and an upper yoke arm 142 having a distal end coupled to the proximate end of the upper gripping jaw 130. A connector 124 couples the proximate ends of the lower and upper yoke arms 140 and 142 together. The lower and upper yoke arms 140 and 142 may be pivotally connected to the lower and upper gripping arms 128 and 130, respectively.

The orientation of the locking bar 126 may be adjustable to receive the lower and upper gripping jaws 128 and 130 when the door 104 is closed. In a particular embodiment, the bolt 110 can be rotated clockwise to move the locking bar 126 towards the open end of the debris tank 102, and counter clockwise to move the locking bar in the opposite direction.

Many modifications and other embodiments of the invention will come to the mind of one skilled in the art having the benefit of the teachings presented in the foregoing descriptions and the associated drawings. Therefore, it is understood that the invention is not to be limited to the specific embodiments disclosed, and that modifications and embodiments are intended to be included within the scope of the appended claims.

That which is claimed is:

1. A door locking device for hydro excavation equipment comprising a debris tank having an open end and a door pivotally connected thereto, the door locking device comprising:

a grapple support housing secured to the door and having a first side and an opposing second side;

a lower gripping jaw having a lower pin coupled between the first side and the second side of the grapple support housing defining a lower axis about which the lower gripping jaw is configured to rotate;

an upper gripping jaw having an upper pin coupled between the first side and the second side of the grapple support housing defining an upper axis about which the upper gripping jaw is configured to rotate;

a yoke having a first end coupled to proximate ends of the lower and upper gripping jaw; and an actuator coupled to a second end of the yoke and configured to extend and retract the yoke to cause the lower and upper gripping jaws to rotate in response thereto about the lower axis and the upper axis, respectively.

2. The door locking device of claim 1, further comprising a locking bar mounted inside the debris tank and orientated to receive distal ends of the lower and upper gripping jaws grip thereto to lock the door over the open end of the debris tank when closed.

3. The door locking device of claim 1, wherein the yoke comprising:

a lower yoke arm having a distal end coupled to the proximate end of the lower gripping jaw;

an upper yoke arm having a distal end coupled to the proximate end of the upper gripping jaw; and a connector having a first end coupled to proximate ends of the lower and upper yoke arms.

4. The door locking device of claim 2, wherein the orientation of the locking bar is adjustable to receive the lower and upper gripping jaws when the door is closed.

5. The door locking device of claim 2, wherein the distal ends of the lower and upper gripping jaws are configured to move closer together to grip the locking bar when the actuator is extended, and to move further apart to release the locking bar when the actuator is retracted.

6. The door locking device of claim 1, wherein the lower axis and the upper axis are disposed at a midpoint of the lower and upper gripping jaws, respectively.

7. The door locking device of claim 3, wherein the lower and upper yoke arms are pivotally connected to the lower and upper gripping arms, respectively.

8. The door locking device of claim 1, further comprising a bell housing secured to the actuator.

9. The door locking device of claim 1, wherein the door locking device is concentrically mounted to the door.

10. The door locking device of claim 2, further comprising a locking bar support having a bolt configured to change a distance of the locking bar to the lower and upper gripping jaws when the door is closed.

11. The door locking device of claim 1, wherein the lower gripping jaw comprises a pair of arms configured to have the upper gripping jaw therebetween when the door is closed.

12. The door locking device of claim 1, wherein the lower gripping jaw is oriented to grip a lower surface of the locking bar and the upper gripping jaw is orientated to grip an upper surface of the locking bar when the door is closed.

13. The door locking device of claim 1, wherein the grapple support housing further comprises a cover positioned over the lower and upper gripping jaws to protect from debris inside the debris tank.

14. A system for hydro excavation comprising:

a debris tank;

a door pivotally secured over an open end of the debris tank;

a door locking device comprising a grapple support housing secured to the door and having a first side and an opposing second side, a lower gripping jaw having a lower pin coupled between the first side and the second side of the grapple support housing defining a lower axis about which the lower gripping jaw is configured to rotate, an upper gripping jaw having an upper pin coupled between the first side and the second side of the grapple support housing defining an upper axis about which the upper gripping jaw is configured to rotate, a yoke having a first end coupled to proximate ends of the lower and upper gripping jaw, and an actuator coupled to a second end of the yoke and configured to extend and retract the yoke to cause the lower and upper gripping jaws to rotate in response thereto about the lower axis and the upper axis, respectively; and a locking bar mounted inside the debris tank and orientated to receive distal ends of the lower and upper gripping jaws grip thereto to lock the door over the open end of the debris tank when closed.

15. The system of claim 14, wherein the orientation of the locking bar is adjustable to receive the lower and upper gripping jaws when the door is closed.

16. The system of claim 14, wherein the distal ends of the lower and upper gripping jaws are configured to move closer together to grip the locking bar when the actuator is extended, and to move further apart to release the locking bar when the actuator is retracted.

17. The system of claim 14, wherein the lower axis and the upper axis are disposed at a midpoint of the lower and upper gripping jaws, respectively.

18. The system of claim 14, wherein the door locking device is concentrically mounted to the door.

19. The system of claim 14, wherein the lower gripping jaw comprises a pair of arms configured to have the upper gripping jaw therebetween when the door is closed.

20. A door locking device for a debris tank comprising:

a grapple support housing having a first side and an opposing second side;

a lower gripping jaw having a lower pin coupling the lower gripping jaw to the grapple support housing defining a lower axis about which the lower gripping jaw is configured to rotate;

an upper gripping jaw having an upper pin coupling the upper gripping jaw to the grapple support housing defining an upper axis about which the upper gripping jaw is configured to rotate;

a yoke having a first end coupled to proximate ends of the lower and upper gripping jaw; and an actuator coupled to a second end of the yoke and configured to extend and retract the yoke to cause the lower and upper gripping jaws to rotate in response thereto about the lower axis and the upper axis, respectively, to lock a door over an open end of a debris tank.

* * * * *